US012378862B1

(12) United States Patent
Al-Obaid et al.

(10) Patent No.: US 12,378,862 B1
(45) Date of Patent: Aug. 5, 2025

(54) PARTICULATE BUFFER FOR ATTENUATING CORROSION OF DISSOLVABLE FRAC PLUG

(71) Applicant: Saudi Arabian Oil Company, Dhahran (SA)

(72) Inventors: Hashem Al-Obaid, Dhahran (SA); Scott Fraser Ashby, Dhahran (SA); Bassam Al-Mulhim, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/742,658

(22) Filed: Jun. 13, 2024

(51) Int. Cl.
*E21B 43/26* (2006.01)
*E21B 41/02* (2006.01)

(52) U.S. Cl.
CPC ..... *E21B 43/26* (2013.01); *E21B 41/02* (2013.01); *E21B 2200/08* (2020.05)

(58) Field of Classification Search
CPC ..... E21B 43/26; E21B 41/02; E21B 2200/08
See application file for complete search history.

(56) References Cited

U.S. PATENT DOCUMENTS 8,726,991 B2 * 5/2014 Boney ..... E21B 43/261 166/305.1
9,187,977 B2 11/2015 Alvarez et al.
9,759,039 B1 * 9/2017 Hardesty ..... E21B 33/13
10,119,359 B2 * 11/2018 Frazier ..... E21B 43/26
10,125,568 B2 11/2018 Fripp et al.
10,156,118 B2 12/2018 Fripp et al.
10,156,126 B2 * 12/2018 Hardesty ..... E21B 43/11852
10,301,909 B2 5/2019 McCoy et al.
10,316,616 B2 6/2019 Stafford et al.
10,352,125 B2 7/2019 Frazier
10,704,354 B2 * 7/2020 Hamid ..... E21B 43/26
11,072,991 B2 7/2021 Martin et al.
11,142,989 B2 * 10/2021 Gan ..... E21B 43/26
11,448,033 B2 9/2022 Fripp et al.
2018/0306027 A1 * 10/2018 Sherman ..... E21B 29/00
2019/0078414 A1 * 3/2019 Frazier ..... E21B 34/063
2021/0025251 A1 1/2021 Xi
2023/0304373 A1 9/2023 Robertson et al.

* cited by examiner

*Primary Examiner* — Aaron L Lembo
(74) *Attorney, Agent, or Firm* — Bracewell LLP; Constance G. Rhebergen; Keith R. Derrington

(57) ABSTRACT

A wellbore operation for increasing fluid production from a surrounding formation includes multiple stages of wellbore stimulation. In each stage a different zone of the formation is fractured by injecting a stimulation fluid into the wellbore, which creates fractures in the formation zone. Adjacent formation zones are isolated from one another during fracturing by setting plugs in the wellbore between them. On each of the plugs is a buffer that attenuates a corrosive effect on the plugs from the stimulation fluid, and so that the plugs retain sufficient integrity to isolate adjacent zones from one another until all stimulation stages are completed.

20 Claims, 6 Drawing Sheets

PARTICULATE BUFFER FOR ATTENUATING CORROSION OF DISSOLVABLE FRAC PLUG

BACKGROUND OF THE INVENTION

1. Field of Invention

The present disclosure relates to a stimulating production from a hydrocarbon producing wellbore, and in particular relates to extending the operational functionality of dissolvable frac plugs used during a wellbore stimulation procedure.

2. Description of Prior Art

Hydrocarbon producing wellbores extend subsurface and intersect subterranean formations where hydrocarbons are trapped. Drilling systems are typically used to excavate the wellbores that include drill bits that are on the end of a drill string, and a drive system above the opening to the wellbore that rotates the drill string and bit. Cutting elements on the drill bit scrape the bottom of the wellbore as the bit is rotated, and excavate rock from the formation thereby deepening the wellbore. During drilling operations, drilling fluid is normally pumped down the drill string and discharged from the drill bit into the wellbore. The drilling fluid flows back up the wellbore in an annulus between the drill string and walls of the wellbore. Cuttings produced while excavating are carried up the wellbore with the circulating drilling fluid.

Well stimulation, such as fracturing, is sometimes performed to promote hydrocarbon production from the surrounding formation. Fracturing generally involves injecting high pressure fluid into the wellbore to create fractures from the wellbore outer diameter into the formation, which increases drainage volume from the formation into the wellbore. Often, packers or plugs are installed in the well to seal off a particular portion of the wellbore for fracturing fluid injection, so that fractures are in a designated zone of the formation. Fracturing is often performed in stages, where subsequent stages are conducted at lower depths than previous stages. Further stimulation of the wellbore sometimes involves adding fluids, such as acidizing fluids, with the fracturing fluid. Some types of plugs retain their integrity when subjected to the acidizing fluid, and are removed from the wellbore by milling, which is costly and time consuming. Other types of plugs are designed to dissolve when exposed to acidizing fluids. A problem with dissolvable plugs is that they often dissolve too quickly, and cannot provide zonal isolation before all stimulation stages are completed.

SUMMARY OF THE INVENTION

Disclosed herein is a method of operating in a wellbore that includes isolating adjacent zones in the wellbore from one another by setting a dissolvable plug in the wellbore and between the adjacent zones, introducing into the wellbore a stimulating fluid that is corrosive to the dissolvable plug, and forming a buffer on the dissolvable plug that attenuates the corrosive effect from the stimulating fluid to the dissolvable plug. In an alternative, the method includes conducting multiple stages of wellbore stimulation by repeating these steps. In an example, the dissolvable plug dissolves after all stages of wellbore stimulation are completed. The method further optionally includes producing fluid from the wellbore after the dissolvable plug dissolves. In an embodiment, the method includes pressurizing the stimulating fluid to a pressure that creates fractures in the wellbore. An example of the buffer includes particles that are corroded by exposure to the stimulating fluid, which in one example the particles are calcium carbonate. The step of forming a buffer on the dissolvable plug optionally includes suspending the particles in a suspension fluid to form a slurry and injecting the slurry into the wellbore. In an alternative to this example, an amount of slurry is injected so that an upper level of the slurry is above a set of perforations that are adjacent the plug. The method further optionally includes allowing the particles to settle from the slurry and collect on an upper surface of the dissolvable plug to form the buffer.

Another method of operating in a wellbore is disclosed that includes isolating adjacent zones in the wellbore from one another by setting a dissolvable plug in the wellbore and between the adjacent zones and buffering the dissolvable plug from the effects of corrosive agents to attenuate dissolving of the dissolvable plug. The method further optionally includes introducing a stimulating fluid into the wellbore that is corrosive to the dissolvable plug and to the buffer, pressurizing the stimulating fluid to form fractures in a formation surrounding the wellbore, and repeating the remaining steps. The step of adding a buffer on the dissolvable plug optionally includes disposing a slurry into the wellbore that comprises particles and a suspension fluid. In an example, the particles are allowed to fall from the suspension fluid and settle on the dissolvable plug to form a buffer. In an embodiment, the stimulating fluid is pressurized after the buffer is formed. In an example, an upper level of the slurry in the wellbore submerges a set of perforations adjacent the dissolvable plug. The steps are optionally repeated multiple times to define multiple stages of stimulation where multiple dissolvable plugs are set in the wellbore, and where the dissolvable plugs all dissolve after all stages of stimulation are completed.

BRIEF DESCRIPTION OF DRAWINGS

Some of the features and benefits of the present invention having been stated, others will become apparent as the description proceeds when taken in conjunction with the accompanying drawings, in which.

Figure 1:
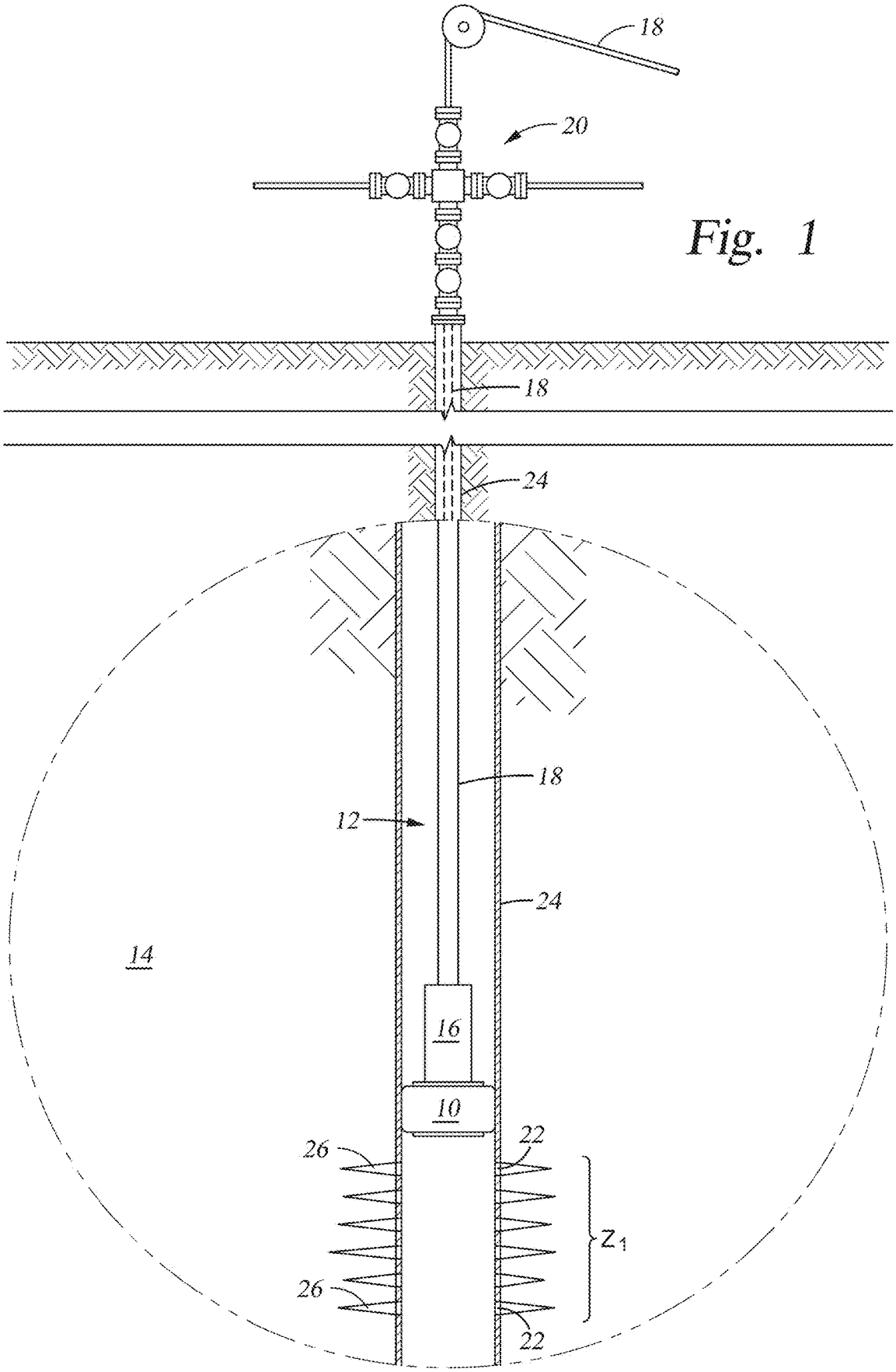
FIG. 1 is a side partial sectional view of an example of setting a dissolvable plug in a wellbore.

While subject matter is described in connection with embodiments disclosed herein, it will be understood that the scope of the present disclosure is not limited to any particular embodiment. On the contrary, it is intended to cover all alternatives, modifications, and equivalents thereof.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in a side sectional view in FIG. 1 is an example of setting a frac plug 10 in a wellbore 12, which is shown formed into a subterranean formation 14. Hydrocarbons trapped in the formation 14 are to be produced through the wellbore 12. The frac plug 10 is shown being deployed into wellbore 12 on a setting tool 16 mounted on a lower end of coiled tubing 18, which inserts into the wellbore 12 through a wellhead assembly 20 on surface. Wellhead assembly 20 provides pressure control of the wellbore 12, and includes fluids handling hardware for selective injection and production of fluids into and out of the wellbore 12. Extending radially from wellbore 12 is a set of perforations 22, which extend radially outward from wellbore 12 through casing 24 that lines the wellbore 12 and into the surrounding formation. As shown, the frac plug 10 is being installed within wellbore 12 adjacent an upper end of the set of perforations 22. Projecting radially outward from the ends of the set of perforations 22 is a set of fractures 26, which extend radially farther into the formation 14. A zone $Z_1$ is defined in the portions of formation 14 and wellbore 12 intersected by the sets of perforations and fractures 22, 26. As described in more detail below, the frac plug 10 isolates of the portion of wellbore 12 and formation 14 in zone $Z_1$ from portions of wellbore 12 above zone $Z_1$. Further, the frac plug 10 is a dissolvable frac plug, meaning when subjected to certain corrosive fluids, such as acids used in stimulation operations, the frac plug 10 will dissolve and no longer isolate or seal—and then zone $Z_1$ will not be pressure isolated with the portions of wellbore 12 uphole of or at lesser depths where frac plug 10 is installed.

Figure 2:
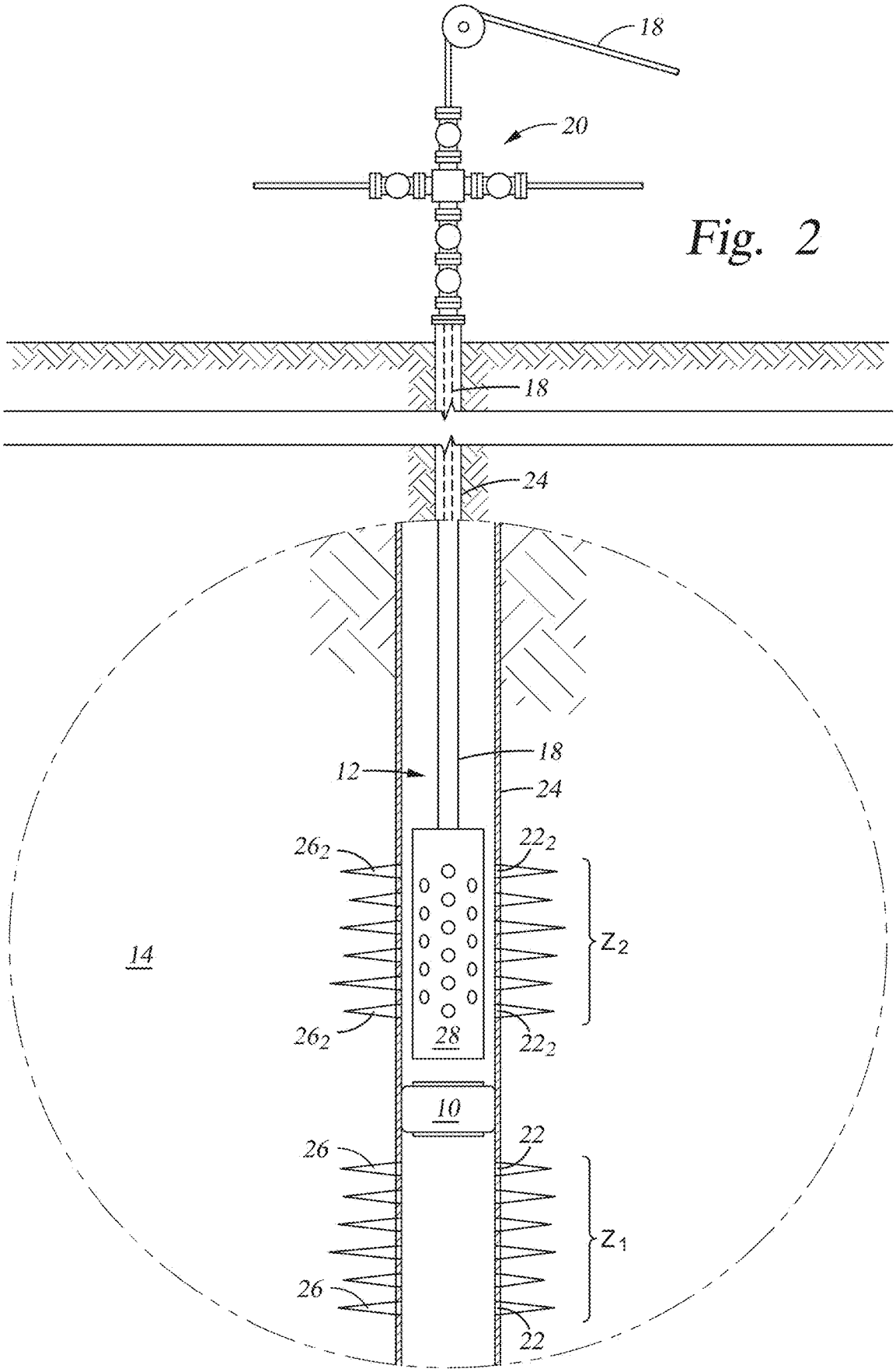
FIG. 2 is a side partial sectional view of an example of forming perforations in the wellbore of FIG. 1.
Figure 3:
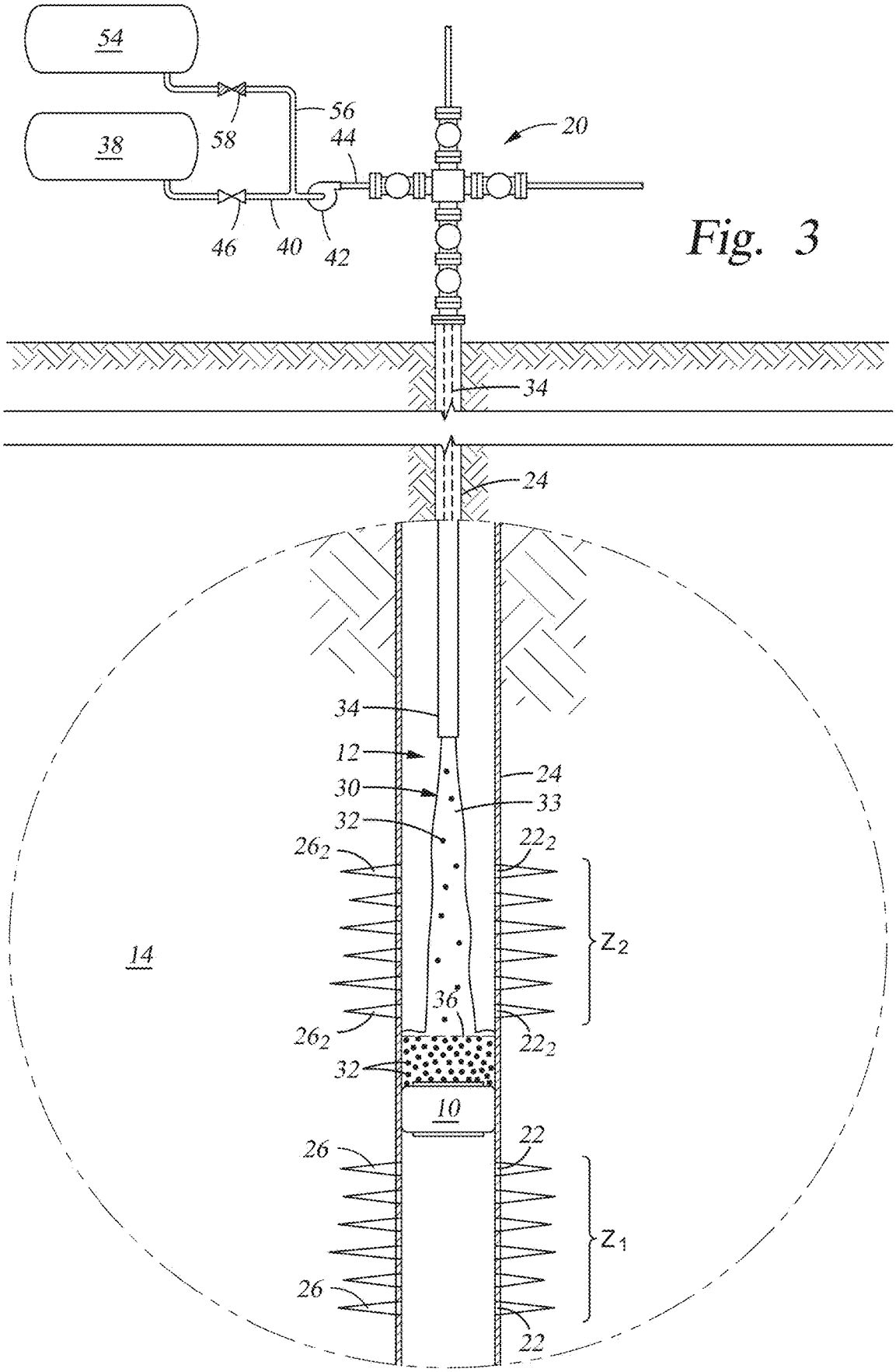
FIG. 3 is a side partial sectional view of an example of injecting buffering slurry into the wellbore of FIG. 1.

An optional subsequent step of the example wellbore stimulation procedure is shown in a side sectional view in FIG. 2. In this example, a perforating gun 28 is inserted within wellbore 12 depending from coiled tubing 18. Optional deployment means for lowering the perforating gun 28 into the wellbore 12 include wireline, slickline, or cable (not shown). Strategically arranged shaped charges (not shown) are included with the perforating gun 28 that when detonated form a second set of perforations $\mathbf{22}_2$ into the formation 14 and at a depth less than that of zone $Z_1$ Shown in a side sectional view in FIG. 3 is a slurry 30 being injected into the wellbore 12. In this example, slurry 30 is made up of particles 32 and a suspension fluid 33. In examples the particles 32 make up around 20% percent by volume of the slurry 30, in alternatives, the percent by volume of the slurry 30 made up by the particles 32 ranges from around 10% to around 30% and all values between. Examples of the suspension fluid 33 include a polymer gel fluid, cross linked polymer gel fluid (ground and in-situ), guar gum fluids, water, water based fluids, oil based fluids, and combinations thereof. The slurry 30 is deposited into the wellbore 12 through a deployment tubular 34 depicted with an upper end connected to the wellhead assembly 20. In alternatives, slurry 30 is injected directly into the wellbore 12 through the wellhead assembly 20, and allowed to fall into the wellbore 12 from a lower end of wellhead assembly 20. In the alternative shown, the amount of slurry 30 delivered into wellbore 12 is of an amount so that when collected on frac plug 10, an upper level 36 of particles 32 in the slurry 30 is at a lower end of the set of perforations $\mathbf{22}_2$ so that slurry 30 is below the entire set of perforations $\mathbf{22}_2$. Alternatively, the upper level 36 is above or intersects the set of perforations $\mathbf{22}_2$. Outside the wellbore 12 slurry 30 is contained in a slurry source 38 shown on surface, which during the injection of slurry 30 is selectively discharged into a slurry supply line 40 that leads to an inlet of a pump 42. Pump 42 pressurizes the slurry 30 and discharges it into a discharge line 44, which carries the slurry 30 to the wellhead assembly 20. A valve 46, shown in the open configuration, is in the slurry supply line 40, and that by opening and closing selectively isolates slurry source 38 from downstream of valve 46. Slurry source 38, in examples, includes a tank, a vessel, in which the suspension fluid 33 and particles 32 are combined. In examples, the particles include magnesium based compounds, calcium based compounds, such as calcium carbonate ($CaCO_3$), or any acid soluble particle.

Figure 4:
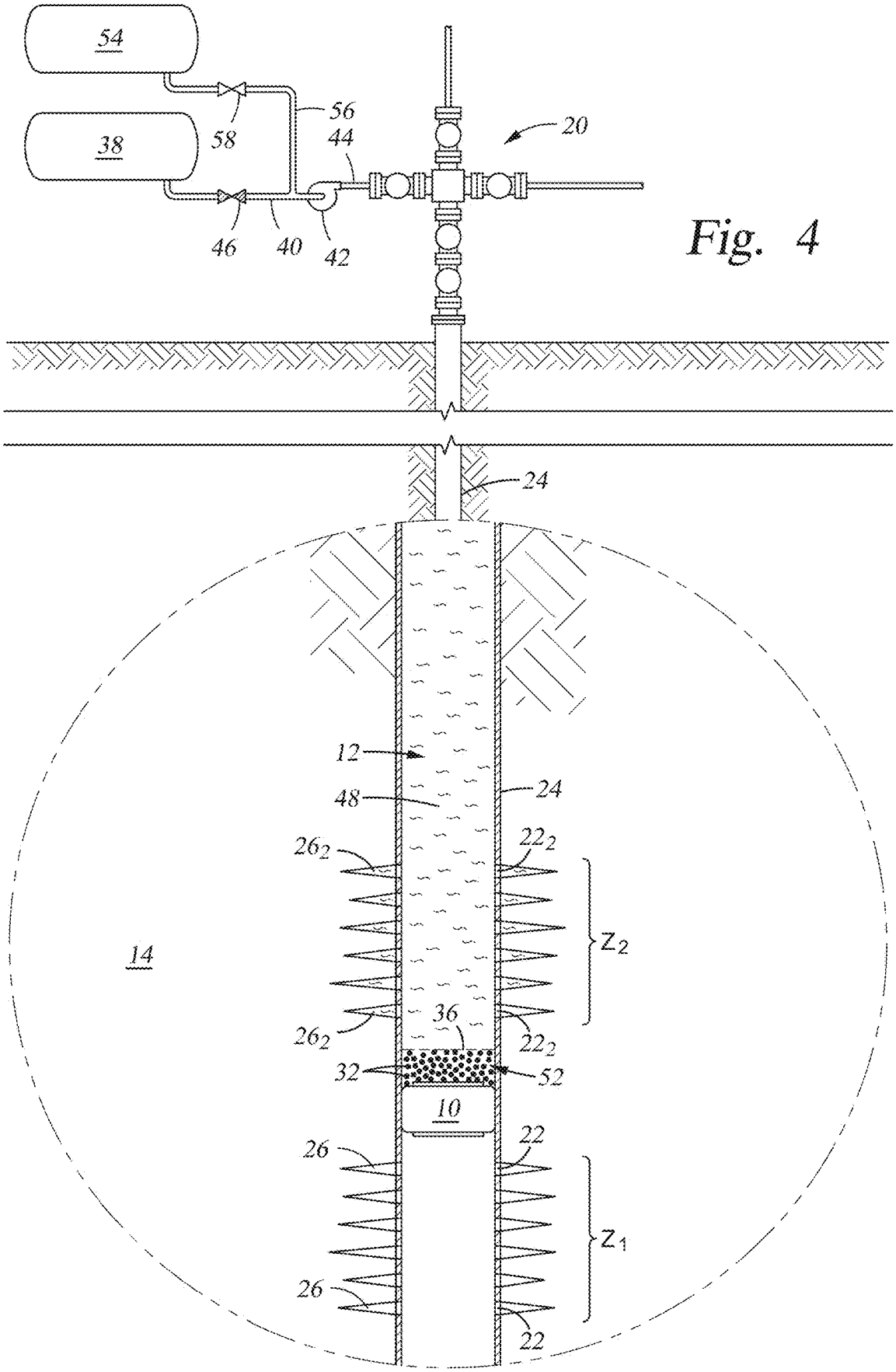
FIG. 4 is a side partial sectional view of an example of creating fractures from the perforations of FIG. 2.

Referring now to FIG. 4, the particles 32 are shown having settled within the slurry 30 so that the upper level 36 is at a greater depth, or lower, than in FIG. 3, which increases the density of the particles 32. The period of time to allow the settling of the particles 32 is dependent on wellbore conditions and is determinable by those skilled in the art. In the example step of FIG. 4, the fracturing fluid 48 is injected into the wellbore 12 after the particles 32 have been allowed to settle on top of the frac plug 10. The fracturing fluid 48 is shown flowing into the wellbore 12 through the wellhead assembly 20. In an alternative, the fluid 48 is injected through the deployment tubular 34 (FIG. 3), and a packer (not shown) is included to isolate uphole portions of wellbore 12 from the high pressure fracturing fluid 48. The fracturing fluid 48 is at a flowrate and pressure sufficient to create a set of fractures $\mathbf{26}_2$ shown extending radially outward into formation 14 from the set of perforations $\mathbf{22}_2$. As noted above, the frac plug 10 is susceptible to being degraded in response to the corrosive effects of certain fluids, such acidizing fluids. In an example, acidizing fluids are included with the fracturing fluid 48 for stimulating flow from the formation 14. A buffer 52 is formed when allowing the particles 32 to settle into a denser formation on the frac plug 10, which attenuates corrosion of the frac plug 10 by the fracturing fluid 48 or other stimulation fluids present in the wellbore 12.

Still referring to FIG. 4, the sets of perforations and fractures $\mathbf{22}_2$, $\mathbf{26}_2$ are in a zone $Z_2$ in formation 12, which is above zone $Z_1$, and isolated from zone $Z_1$ by the frac plug 10. Further shown in FIG. 4 is a frac fluid source 54, which in examples includes a tank or a vessel, or portable vehicle, and that includes an amount of fracturing fluid 48 to be injected into wellbore 12. As shown, a frac fluid supply line 56 extends between the source 54 and pump 42 and includes a valve 58. Valve 58 is shown in the open configuration allowing flow from the frac fluid source 54 to the inlet of pump 42, and valve 46 in line 40 is in the closed configuration which blocks communication to the slurry source 38. In FIG. 3 valve 58 in line 56 is shown in a closed configuration blocking flow from frac fluid source 54 to pump 42. Line 56 intersects with line 40 downstream of valve 58. Similar to that described above, the pressurized fracturing fluid 48 is discharged from pump 42 into discharge line 44 where it then flows to the wellhead assembly 20 and is directed into wellbore 12.

Figure 5:
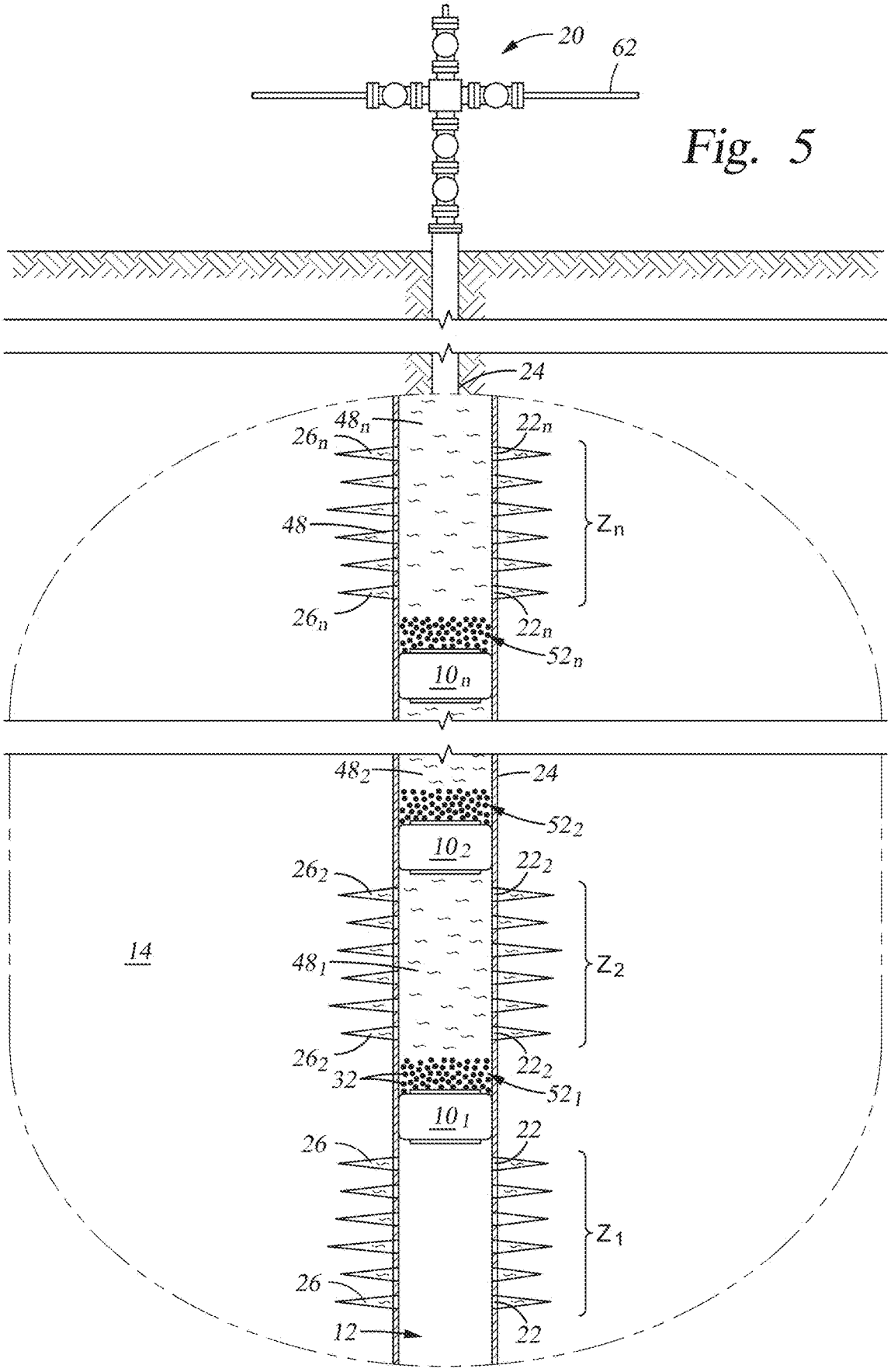
FIG. 5 is a side partial sectional view of an example of the wellbore of FIG. 1 having undergone multiple stages of stimulation.

Shown in FIG. 5 is an example of the wellbore 12 and formation 14 after having undergone multiple stages of wellbore stimulation in zones, in addition to the stimulation performed in zones $Z_1$, $Z_2$. For brevity, the additional zones having undergone wellbore stimulation are represented by zone Zn, which is at a lower depth than and uphole of zones $Z_1$, $Z_2$. In the example of FIG. 5, in zone Zn is a frac plug $\mathbf{10}_n$ which separates zone Zn from portions of wellbore 12 at greater depths than zone Zn, and a buffer $\mathbf{52}_n$ is shown formed on an uphole side of the frac plug $\mathbf{10}_n$. Further, a set of perforations $\mathbf{22}_n$ is shown extending radially outward from wellbore 12, through the casing 24, and into formation 14, and a set of fractures $\mathbf{26}_n$ are extending radially outward from the set of perforations $\mathbf{22}_n$. Above each of the frac plugs $\mathbf{10}_1$, $\mathbf{10}_2$, . . . , $\mathbf{10}_n$ is an amount of fracturing fluid $\mathbf{48}_1$, $\mathbf{48}_2$, . . . , $\mathbf{48}_n$. Although the fluid $\mathbf{48}_{1\text{-}n}$ is corrosive to the material making up each of the frac plugs $\mathbf{10}_{1\text{-}n}$, the presence of the buffers $\mathbf{52}_1$, $\mathbf{50}_2$, . . . , $\mathbf{50}_n$. attenuates the corrosive effects to delay dissolving or degradation of the frac plugs $\mathbf{10}_{1\text{-}n}$ so that isolation between adjacent zones $Z_{1\text{-}n}$ is maintained until all the stages of stimulation have been completed. In examples, the overall time period of attenuation is dependent upon the ratios of the particles 32 contained within slurry 30 as well as the overall amount of slurry 30 being delivered into the wellbore 12 with each stage of stimulation.

Figure 6:
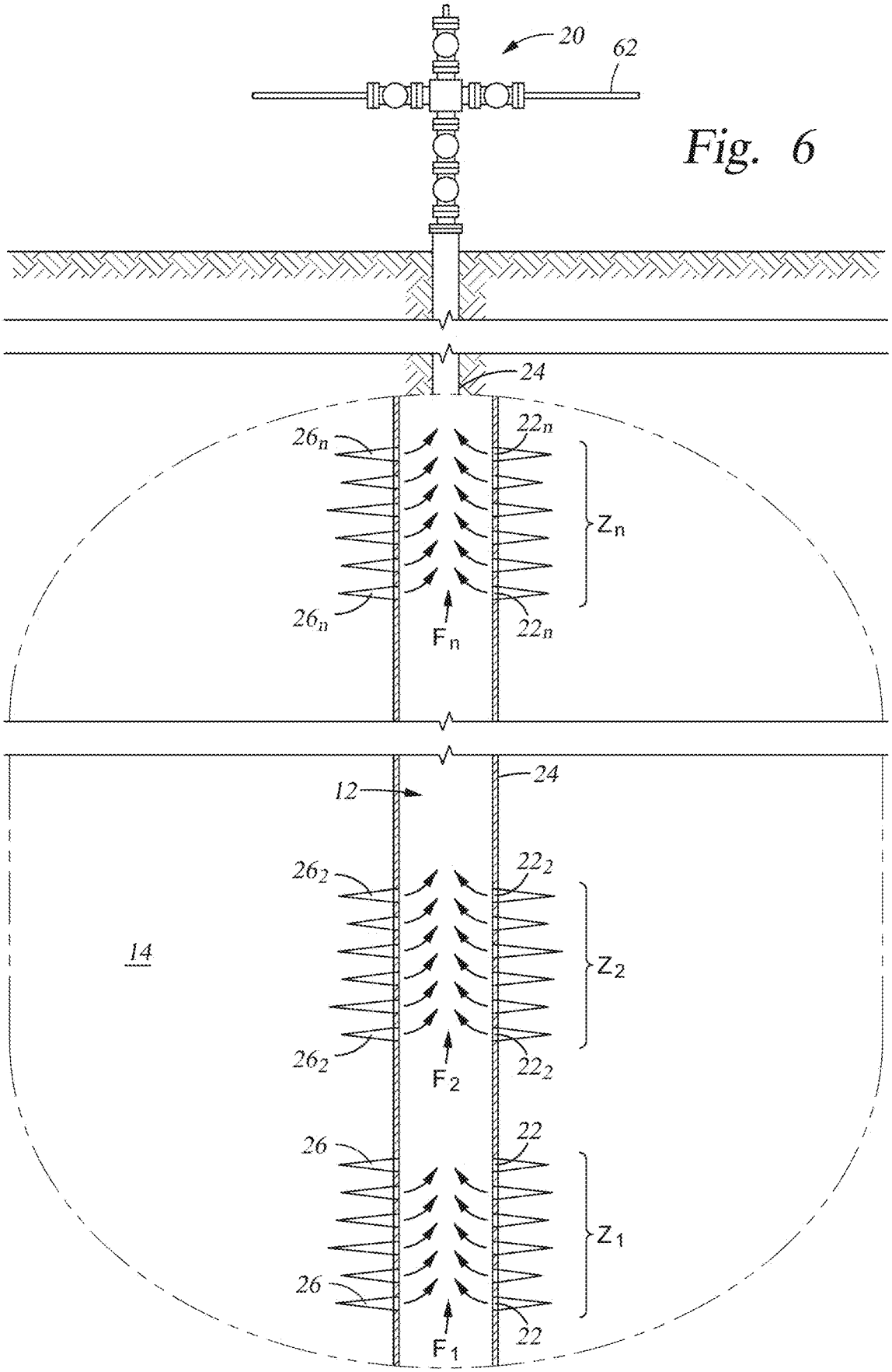
FIG. 6 is a side partial section view of an example of producing fluid from the wellbore of FIG. 5.

Shown in a side sectional view in FIG. 6 is that fluid is shown flowing into the wellbore 12 from the formation 14, which is directed to wellhead assembly 20. In an alternative, fluid flows upward to wellhead assembly 20 inside of production tubing (not shown) added to a lower end of the wellhead assembly 20 and that extends into the wellbore 12; the production tubing is added after the multiple stages of wellbore stimulation have been completed. The produced fluid is transported off site for storage, processing, and or transportation via a production line 62 that attaches to a side valve of the wellhead assembly 20. Fluid is made up of fluid $F_1$ from zone $Z_1$, fluid $F_2$ from zone $Z_2$, and fluid $F_n$ from zone Zn. An advantage provided by the present disclosure is that when conducting stimulation procedures in any of the different zones $Z_{1\text{-}n}$ the integrity of the frac plugs $\mathbf{10}_{1\text{-}n}$ between each of these zones $Z_{1\text{-}n}$ remains intact until the multiple stages of wellbore stimulation have been completed in each of zones $Z_{1\text{-}n}$, which maintains isolation between adjacent zones throughout the entire process.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of operating in a wellbore comprising:

a. isolating adjacent zones in the wellbore from one another by setting a dissolvable plug in the wellbore and between the adjacent zones;

b. introducing into the wellbore a stimulating fluid that is corrosive to the dissolvable plug; and c. forming a buffer on the dissolvable plug, the buffer comprising particles that attenuate the corrosive effect from the stimulating fluid to the dissolvable plug.

2. The method of claim 1, further comprising conducting multiple stages of wellbore stimulation by repeating steps (a)-(c).

3. The method of claim 2, wherein the dissolvable plug dissolves after all stages of wellbore stimulation are completed.

4. The method of claim 3, further comprising producing fluid from the wellbore after the dissolvable plug dissolves.

5. The method of claim 1, further comprising (d) pressurizing the stimulating fluid to a pressure that creates fractures in the wellbore.

6. The method of claim 1, wherein the particles are corroded by exposure to the stimulating fluid.

7. The method of claim 6, wherein the particles comprise calcium carbonate.

8. The method of claim 1, wherein the step of forming a buffer on the dissolvable plug comprises suspending the particles in a suspension fluid to form a slurry and injecting the slurry into the wellbore.

9. The method of claim 8, an amount of slurry is injected so that an upper level of the slurry is above a set of perforations that are adjacent the plug.

10. The method of claim 8, further comprising allowing the particles to settle from the slurry and collect on an upper surface of the dissolvable plug to form the buffer.

11. A method of operating in a wellbore comprising:

a. isolating adjacent zones in the wellbore from one another by setting a dissolvable plug in the wellbore and between the adjacent zones; and b. buffering the dissolvable plug from the effects of corrosive agents to attenuate dissolving of the dissolvable plug by disposing a slurry into the wellbore that comprises particles and a suspension fluid.

12. The method of claim 11, further comprising (c) introducing a stimulating fluid into the wellbore that is corrosive to the dissolvable plug and to the buffer, (d) pressurizing the stimulating fluid to form fractures in a formation surrounding the wellbore, and (e) repeating steps (a)-(d).

13. The method of claim 12, wherein the particles are acid soluble.

14. The method of claim 13, further comprising allowing the particles to fall from the suspension fluid and settle on the dissolvable plug to form a buffer.

15. The method of claim 14, wherein the stimulating fluid is pressurized after the buffer is formed.

16. The method of claim 13, wherein an upper level of the slurry in the wellbore submerges a set of perforations adjacent the dissolvable plug.

17. The method of claim 12, wherein steps (a)-(d) are repeated multiple times to define multiple stages of stimulation where multiple dissolvable plugs are set in the wellbore, and wherein the dissolvable plugs all dissolve after all stages of stimulation are completed.

18. A method of operating in a wellbore comprising:

isolating adjacent zones in the wellbore from one another by setting a dissolvable plug in the wellbore and between the adjacent zones; and adding particles to the plug to buffer the plug from degrading effects of stimulation fluid.

19. The method of claim 18, wherein the particles are in a slurry that further comprises a suspension fluid.

20. The method of claim 18, wherein the zones comprise a multiplicity of zones, the method further comprising conducting wellbore stimulation in each of the zones, setting a dissolvable plug between zones that are adjacent, adding particles to each of the plugs to buffer each plug from degrading effects of stimulation fluid, and wherein the dissolvable plugs dissolves after all stages of wellbore stimulation are completed.

* * * * *